United States Patent [19]

Martell et al.

[11] Patent Number: 4,548,143

[45] Date of Patent: Oct. 22, 1985

[54] METHOD AND APPARATUS FOR VARYING THE LENGTH OR STITCHES SEWN BY A SEWING MACHINE IN DEPENDENCE UPON SEWING SPEED

[75] Inventors: Charles R. Martell; Donald D. Isett, both of Dallas; Stephen S. Treadwell, Richardson, all of Tex.

[73] Assignee: Microdynamics, Inc., Dallas, Tex.

[21] Appl. No.: 566,656

[22] Filed: Dec. 29, 1983

[51] Int. Cl.[4] ..... D05B 19/00

[52] U.S. Cl. ..... 112/121.11; 112/275; 112/262.1

[58] Field of Search ..... 112/121.11, 121.12, 112/275, 277, 315, 316, 317, 314, 2, 272, 262.1

[56] References Cited

U.S. PATENT DOCUMENTS 4,359,953 11/1982 Martell et al. ..... 112/121.11

4,404,919 9/1983 Martell et al. ..... 112/262.1

*Primary Examiner*—Peter Nerbun

*Attorney, Agent, or Firm*—Jerry W. Mills; Gregory M. Howison

[57] ABSTRACT

An adaptive semi-automatic sewing system (10) comprises a sewing machine (12), a drive unit (42) including a variable speed motor and encoder for counting stitches sewn and for sensing the rotation of the motor, at least one material edge sensor (40) mounted ahead of the needle (22) of the sewing machine, and a microprocessor controller (51) coupled to the sewing machine controls. Accurate control of seam lengths and end points is achieved by initiating countdown of a variable number of final stitches responsive to detection of the material edge of the sensors (40). The speed of the sewing machine at the time the material edge is detected is monitored and compared to a reference speed. The number of final stitches is then dynamically adjusted to compensate for the speed variance from the reference speed.

22 Claims, 6 Drawing Figures

FIG. 1
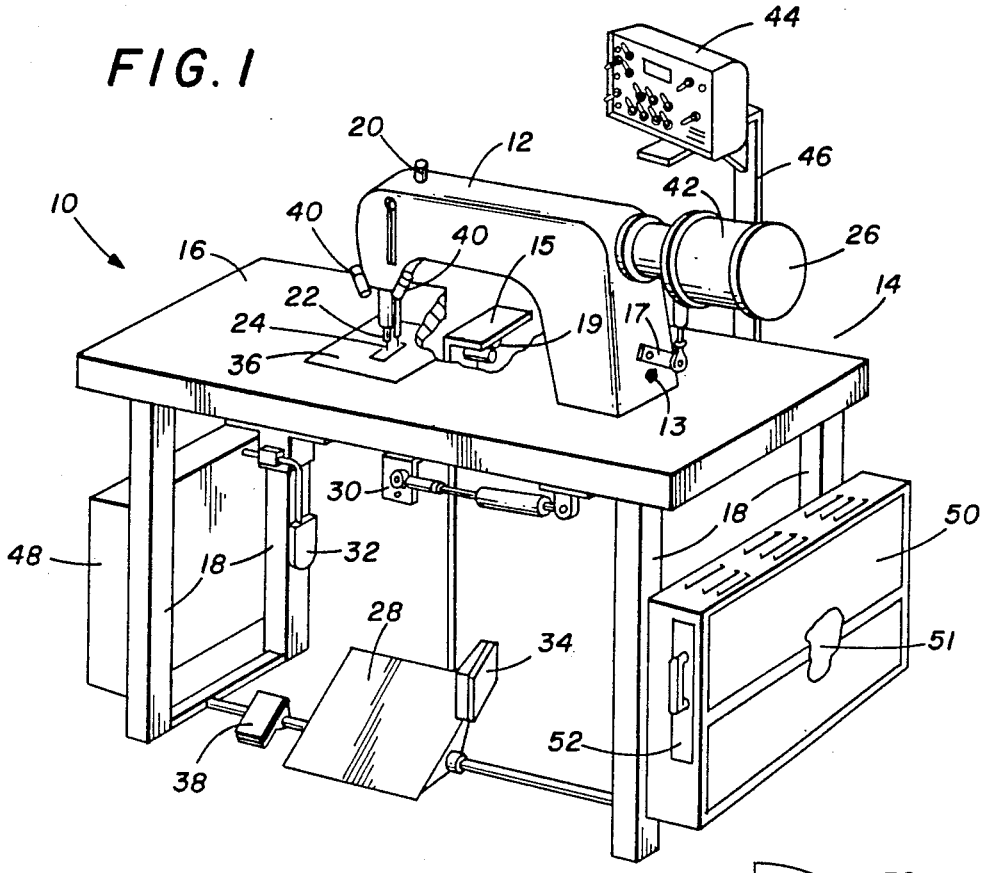
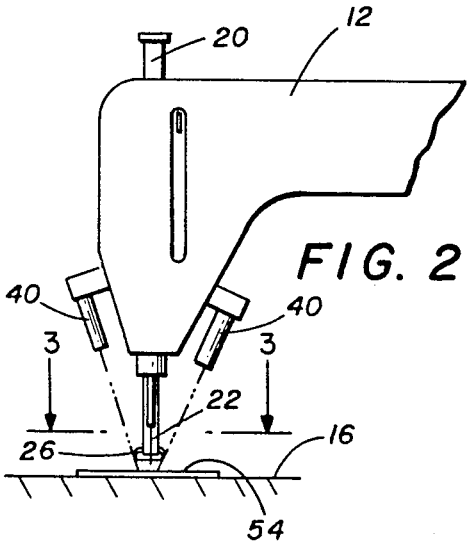
FIG. 2
FIG. 3
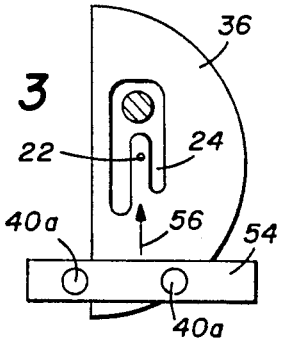
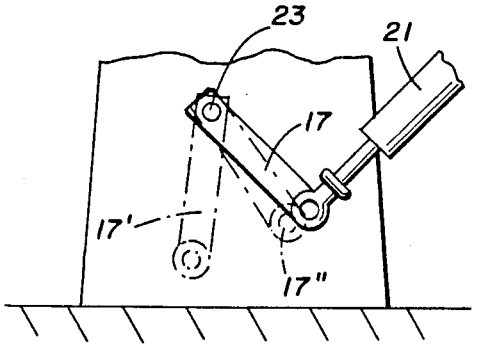
FIG. 4

METHOD AND APPARATUS FOR VARYING THE LENGTH OR STITCHES SEWN BY A SEWING MACHINE IN DEPENDENCE UPON SEWING SPEED

TECHNICAL FIELD

The present invention relates generally to a control system to adapt a sewing machine for semi-automatic operation. More particularly, this invention is directed to an adaptive sewing machine control system incorporating a microprocessor controller in combination with a stitch counter, an edge sensor and stitch length control apparatus to achieve more precise seam lengths and end points.

BACKGROUND OF THE INVENTION

In the sewn goods industry, where various sections of material are sewn together to fabricate products, precise seam lengths and end points are often necessary for proper appearance and function of the finished products. For example, the top stitch seam of a shirt collar must closely follow the contour of the collar and terminate at a precise point which matches the opposite collar. Accurate seam lengths must similarly be maintained in the construction of shoes when sewing together vamps and quarter pieces to achieve strength as well as pleasing appearance. Achieving consistently accurate seam lengths and end points at high rates of production has, however, been a long standing problem in the industry.

Microprocessor controllers have been developed which convert manually operated sewing machines into semi-automatic sewing systems. U.S. Pat. Nos. 4,108,090; 4,104,976; 4,100,865; and 4,092,937, assigned to the Singer Company are representative of such devices. Each of those patents discloses a programmable sewing machine with three operational modes: manual, teach and auto. Control parameters are programmed into the system for subsequent control of the sewing machine in the auto mode. Those microprocessors control all sewing machine functions such as sewing speed, presser foot position, thread trimmer, reverse sew mechanism and the number of stitches sewn in each individual seam. Accurate control of seam lengths is one of the important aspects of those systems.

U.S. Pat. No. 4,404,919, issued Sept. 20, 1983, entitled "Control System for Providing Stitch Length Control of a Sewing Machine", and assigned to assignor describes a microprocessor controlled sewing system which improves upon the seam length accuracy of those systems. The described system controls seam length accuracy using a combination of stitch counting, edge detection and stitch length control techniques. Control of seam lengths and end points is achieved in the system by initiating countdown of a variable number of final whole and partial stitches responsive to detection of the end of the material being sewn by sensors located ahead of the needle. Though the system disclosed in U.S. Pat. No. 4,404,919 provides improved accuracy over the previous systems which relied solely upon stitch counting to determine seam lengths and end points, the system does not account for variations in stitch length with respect to sewing speed. It is known, for example, that stitches sewn at higher speeds are generally longer than stitches sewn at lower speeds. Thus, in a system where a combination of edge sensing and stitch counting is used to accurately control seam margins, stitch length changes due to speed variances may nonetheless cause inaccurate results.

A need has thus arisen for an improved adaptive sewing machine control system which includes a stitch length control technique which compensates for sewing speed.

SUMMARY OF INVENTION

The present invention comprises an adaptive sewing machine control system which substantially improves seam length accuracy by including means for compensating for stitch length changes attributable to speed variances.

In accordance with the invention, there is provided a system including a microprocessor controller which can be programmed with or taught a sequence of sewing operations by the operator in one mode for automatically controlling the machine during subsequent sewing of similar pieces of the same or different sizes in another mode. The semi-automatic system uses a combination of stitch counting and material edge detection techniques to achieve more accurate seam length and end point control.

More specifically, this invention comprises a microprocessor-based control system for an industrial sewing machine. The system has manual, teach and auto modes of operation. In the preferred embodiment, one or more sensors are mounted in front of the presser foot for monitoring edge conditions of the material at the end of each seam. In the teach mode, operating parameters are programmed into the controller by the operator. For each seam, the number of whole and partial stitches x sewn after the desired status change in the sensors are recorded along with sewing machine and auxiliary control inputs. In the auto mode, the number of stitches sewn in each seam is monitored until the characteristic sensor pattern indicating edge detection is seen, at which time x additional stitches are sewn to complete the seam.

The actual number of additional stitches sewn is determined by monitoring the speed of the sewing machine at the time the material edge is detected and comparing that speed to a predetermined reference speed. The number x of stitches remaining to be sewn is then dynamically adjusted to compensate for the speed variance from the reference speed.

BRIEF DESCRIPTION OF DRAWINGS

A more complete understanding of the invention can be had by reference to the following detail description taken in conjunction with the accompanying Drawing, in which:

FIG. 1 is a perspective view of a programmable sewing system incorporating the invention;

FIG. 2 is a front view illustrating placement of the edge sensor relative to the sewing needle;

FIG. 3 is a sectional view taken along lines 3—3 of FIG. 2 in the direction of the arrows;

FIG. 4 is an end view of the sewing system illustrating the automatic control apparatus of the sewing machine reverse mechanism;

DETAILED DESCRIPTION OF THE INVENTION

Figure 5:
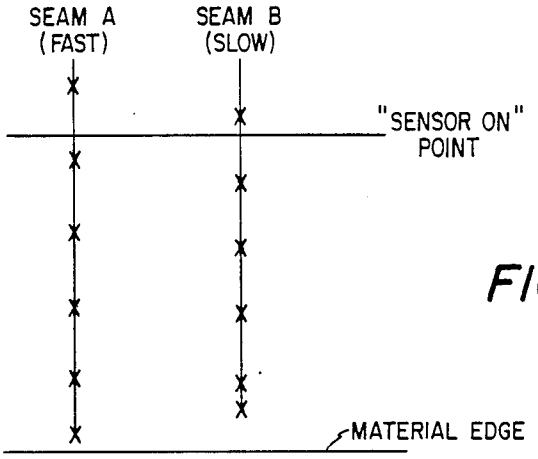
FIG. 5 illustrates the variations in stitch length caused by speed differences.

Referring now to the Drawing, wherein like reference numerals designate like or corresponding parts throughout, FIG. 1 illustrates a semi-automatic sewing system 10 incorporating the invention. System 10 is a microprocessor-based system adapted to extend the capabilities of a sewing machine to enable the operator to perform sewing procedures on a manual or semi-automatic basis.

System 10 includes a conventional sewing machine 12 mounted on a work stand 14 consisting of a table top 16 supported by four legs 18. Sewing machine 12, which is of conventional construction, includes a spool 20 containing a supply of thread for stitching by a reciprocable needle 22 to form a seam in one or more pieces of material. Surrounding needle 22 is a vertically movable presser foot 24 for cooperation with movable feed dogs (not shown) positioned within table top 16 for feeding material past the needle.

A number of standard controls are associated with sewing machine 12 for use by the operator in controlling its functions. A handwheel 26 is attached to the drive shaft (not shown) of machine 12 for manually positioning needle 22 in the desired vertical position. Sewing speed is controlled by a speed sensor 15 which is actuated by a foot treadle 28, which functions as an accelerator. Vertical positioning of presser foot 24 can be controlled by heel pressure on foot treadle 28 which closes a switch 19 in speed sensor 15, which in turn causes the presser foot lift actuator 30 to operate. A leg switch 32 is provided for controlling the sewing direction of machine 12 by causing operation of a reverse sew mechanism 17. A toe switch 34 located adjacent to foot treadle 28 controls a conventional thread trimmer (not shown) disposed underneath the throat plate 36 of machine 12. Foot switch 38 on the other side of foot treadle 28 comprises a one-stitch switch for directing machine 12 to sew a single stitch.

Sewing machine 12 and its associated manual controls are of substantially conventional construction, and may be obtained from several commercial sources, e.g., Singer, Union Special, Pfaff, Consew, Juki, Columbia, Brother or Durkopp Companies.

In addition to the basic sewing machine 12 and its manual controls, system 10 includes several components for adapting the sewing machine for semi-automatic operation. One or more sensors 40 are mounted in laterally spaced-apart relationship in front of needle 22 and presser foot 24. A drive unit 42 comprising a variable speed direct drive motor, sensors for stitch counting and an electromagnetic brake for positioning of needle 22, is attached to the drive shaft of sewing machine 12. A main control panel 44 supported on a bracket 46 is provided above one corner of work stand 14. A pneumatic control chassis 48 containing an air regulator, filter and lubricator for the sewing machine control sensors, pneumatic actuators and other elements of system 10 is provided on one side of work stand 14. All of these components are of known construction and are similar to those shown in U.S. Pat. Nos. 4,108,090; 4,104,976; 4,100,865 and 4,092,937, the disclosures of which are incorporated herein by reference.

A controller chassis 50 is located on the opposite side of work stand 14 for housing the electronic components of system 10. Chassis 50 includes a microprocessor controller 51, appropriate circuitry for receiving signals from sensors and carrying control signals to actuators, and a power module for providing electrical power at the proper voltage levels to the various elements of system 10. The microprocessor controller 51 may comprise a Zilog Model Z-80 microprocessor or any suitable unit having read only memory (ROM) and random access memory (RAM) of adequate storage capacities. An auxiliary control panel 52 is mounted for sliding movement in one end of chassis 50.

Referring now to FIGS. 2 and 3, further details of edge sensors 40 and their cooperation with needle 22 can be seen. Sensors 40 may be mounted directly on the housing of sewing machine 12, or supported by other suitable means. Each sensor 40 comprises a lamp/-photosensor which projects a spot of light **40*a* onto a reflective tape strip 54 on throat plate 36. The status of each sensor 40** is either "on" or "off" depending upon whether or not the light beam thereof is interrupted, such as by passage of the trailing edge or discontinuity of the particular piece of material.

Sensors 40 are positioned in mutually spaced relationship ahead of needle 22 of sewing machine 12. The condition of at least one sensor 40 changes as the trailing material edge passes thereunder to indicate approach of the seam end point. Sensors such as the Model 10-0672-02 available from Clinton Industries of Carlstadt, N.J., have been found satisfactory as sensors 40, however, infrared sensors and emitters, or pneumatic ports in combination with back pressure sensors could also be utilized, if desired.

Circuitry is provided in chassis 50 which detects the output of sensors 40 to generate electrical signals representative of the material edge. Controller 51 is responsive to such edge detection for allowing a selected number of stitches to be sewn after the edge detection.

As described in U.S. Pat. No. 4,404,919, the system may first be operated in a teach mode and thereafter operate in an auto mode. The system may be taught in the teach mode to sew x stitches after the material edge is detected where x can be a combination of whole and partial stitches. Thereafter, when the system is operated in the auto mode, the edge of the material will be automatically detected by the sensor and the machine will then automatically sew x stitches before terminating the seam. In this manner, automatic operation of the system is provided to increase the speed and accuracy of the system without human intervention. The present system operates in essentially the same manner as the system described in U.S. Pat. No. 4,404,919 the disclosure of which is incorporated herein by reference with additional improvement and accuracy being provided by the present invention as will be subsequently described.

In operation of the system thus described, as a seam is sewn by the machine, the number of stitches from the starting point are counted by the encoder within drive unit 42. The reflective tape 54 will be covered by the material and the beams of the sensors 40 are blocked by the material. When the edge of the material moves past the reflective tape 54, the sensor beams are reflected from the reflective tape 54 and sensed. This provides the system with an indication of the location of the edge of the material so that the seam length can be stopped at a given distance from the material edge. The system is originally taught by the operator to sew a given number of whole and partial stitches x in a seam after the edge of the material is detected, and will then sew x stitches before terminating the seam. Depending upon the percentage of the stitch which has been sewn at the time of detection of the material edge, the reverse sew mechanism is positioned to vary the length of the last stitch sewn to provide increased accuracy to the seam termination.

Referring to FIG. 4, an enlarged view of the reverse sew assembly is illustrated. A stepper motor 21 is actuated to pivot reverse sew mechanism 17 about a pivot point 23. Mechanism 17 is illustrated in the solid line position in its normal operating position in the forward sew mode. When the stepper motor 21 is actuated, mechanism 17 is pivoted about pivot point 23 to reduce the length of the last stitch in the seam. It will be understood too that other techniques may be used to vary the length of the last stitch. For example, the material feeding mechanism, known as feed dogs, may be retracted by an air cylinder while the last stitch is being formed. The air cylinder may be operated by a solenoid control actuated by the microprocessor to accurately vary the length of the last stitch formed.

Though the combination of edge detection technique, stitch counting and last stitch variation will theoretically ensure accurate seam margins, stitch length changes due to speed variances may nonetheless cause inaccurate results. In most sewing machines the stitch length will vary with respect to sewing speed, with stitches sewn at higher speed being generally longer than stitches sewn at lower speeds. That phenomenon is illustrated in FIG. 5, which shows two seams, A and B. Seam A is sewn at a higher sewing speed than is seam B and its stitches are therefore longer than the stitches of seam B. Thus, if in this example, the stitches of Seam A are 10% longer than Seam B and if in both instances the system sews 4.15 additional stitches after the sensor detects the edge of the material being sewn at the "sensor-on" point, the end of seam A will be approximately 0.41 stitch closer to the edge of the material than will the end of seam B because of the differences in stitch length.

Figure 6:
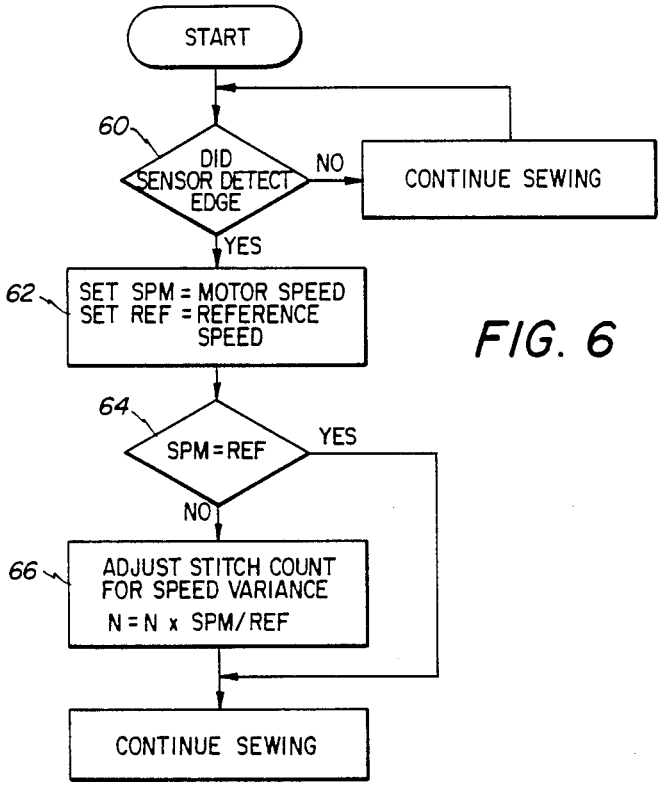
FIG. 6 is a flow chart of the technique of the present invention to dynamically alter the number of stitches sewn after the material edge is detected.

The system of the present invention eliminates that source of inaccuracy by providing a technique which dynamically alters the number of additional stitches sewn after the sensor detects the material edge to compensate for the sewing speed. FIG. 6 is a flow chart illustrating the operation of the present invention. The steps are implemented by suitable programming of microprocessor controller 51. The program is suitable for adaptation to the Zilog Z-80 microprocessor and may be written into Z-80 assembly language in a manner known to the art.

In accordance with the invention, the system sews until the edge of the material is detected at 60. The sewing speed at edge detection is then determined at 62 and compared to a predetermined reference speed at 64. The reference speed may be input by the operator through control panel 44 and stored in the microprocessor memory. If the detected sewing speed equals the reference speed, no adjustment is required and the system will then sew "N" additional stitches, where "N" represents the x stitches programmed to be sewn after edge detection. If the sewing speed is not equal to the reference speed, the number of additional stitches, "N", will be adjusted at 66 to compensate for the speed variance from the reference speed. In FIG. 6, the number of additional stitches sewn is adjusted at 66 by the ratio of the sewing speed to the reference speed. Controller 51 may alternatively be programmed to apply a constant factor of adjustment or to apply a variable factor depending upon only the type of sewing machine or only upon the sewing speed at edge detection. If either of the last two techniques is used, a "look-up" table containing the adjustment factors required for the various sewing machines or sewing speeds is stored in memory and provided as data to controller 51. It will be understood that such stored tables will vary in accordance with different sewing machines and operating conditions. For example, a needle feed sewing machine will typically have less variation in stitch length due to speed than does a drop feed sewing machine.

By adjusting the number of stitches sewn after the sensor detects the material edge to compensate for sewing speed at the time the sensor detects the material edge, accurate seam margins are maintained without regard to sewing speed.

Whereas the present invention has been described with respect to the preferred embodiment thereof, it should be understood that various changes and modifications will be suggested to one skilled in the art, and can be made therein without departing from the spirit and scope of the invention as defined by the appended claims.

What is claimed is:

1. In a sewing machine having a reciprocable needle for stitching seams in material, seam length control apparatus comprising:

means for detecting a material discontinuity in advance of a seam;

means for controlling the reciprocable needle to sew a variable number of stitches after said detecting means detects said material discontinuity; and means for adjusting said variable number of stitches to be sewn in dependence upon the sewing speed at the time of detection of said material discontinuity.

2. The seam control apparatus of claim 1 wherein said adjusting means comprises:

means for determining the sewing speed at the time of detection of said material discontinuity; and means for comparing said sewing speed to a predetermined reference speed.

3. The seam control apparatus of claim 2 wherein said adjusting means varies the number of stitches to be sewn after said material discontinuity is detected if the sewing speed does not equal said predetermined reference speed.

4. The seam control apparatus of claim 2 wherein the number of stitches to be sewn after said material discontinuity is detected are adjusted by a factor equal to the ratio of said predetermined reference speed to said sewing speed.

5. The seam control apparatus of claim 2 wherein the number of stitches to be sewn after said material discontinuity is detected are adjusted in accordance with a predetermined constant factor depending upon the sewing speed when the material discontinuity is detected.

6. The seam control apparatus of claim 2 wherein the number of stitches to be sewn after said material discontinuity is detected are adjusted by a predetermined factor depending upon the material feed characteristics of the sewing machine.

7. In a sewing machine having a material feed and a reciprocable needle for stitching seams in material, a drive motor and a stitch length variance mechanism, seam length control apparatus comprising:

at least one sensor mounted ahead of said needle in a direction opposite the material feed direction for detecting a material discontinuity in advance of a seam;

a microprocessor controller coupled to said sewing machine controls and is responsive to said sensor to operate said reciprocable needle to sew a variable number of stitches after said sensor detects said material discontinuity;

said microprocessor controller including means for adjusting said variable number of stitches to be sewn in dependence upon the sewing speed at the time said material discontinuity is detected.

8. The seam length control apparatus of claim 7 wherein said stitch length variance mechanism comprises:

means for operating the reverse mechanism of the sewing machine to control the length of the last stitch.

9. The seam length control apparatus of claim 7 wherein said stitch length variance mechanism comprises:

means for controlling the operation of the material feed of the sewing machine to control the length of the last stitch.

10. The seam length control apparatus of claim 7 wherein said adjusting means comprises memory means for storing a predetermined adjustment factor, said adjusting means being operative to address said memory means and to adjust said variable number of stitches to be sewn by said adjustment factor.

11. The seam length control apparatus of claim 7 wherein said adjusting means comprises memory means for storing a plurality of predetermined adjustment factors corresponding to various sewing speeds, said adjusting means being further operative to address said memory means to select one of said adjustment factors in dependence upon the sewing speed at the time said material discontinuity is detected and to adjust said variable number of stitches to be sewn by the adjustment factor selected.

12. The seam length control apparatus of claim 7 wherein said adjusting means comprises memory means for storing a plurality of predetermined adjustment factors corresponding to various sewing machine material feed characteristics, said adjusting means being further operative to address said memory means to select one of said adjustment factors in dependence upon the material feed characteristics of the sewing machine and to adjust said variable number of stitches to be sewn by the adjustment factor selected.

13. The seam length control apparatus of claim 7 wherein said adjusting means compares said sewing speed to a predetermined reference speed and adjusts said stitches to be sewn by a factor equal to the ratio of said predetermined reference speed to said sewing speed.

14. A method for controlling seam lengths in a sewing machine having a material feed, a reciprocable needle for stitching seams in material and a microprocessor controller having a memory comprising the steps of:

detecting a material discontinuity in advance of a seam;

controlling the reciprocable needle to sew a variable number of stitches after detecting said material discontinuity; and adjusting said variable number of stitches to be sewn in dependence upon the sewing speed at the time said material discontinuity is detected.

15. The method of claim 14 further comprising the step of:

storing a plurality of adjustment factors corresponding to various sewing machine feed characteristics in said memory.

16. The method of claim 15 wherein said adjusting step comprises:

determining the sewing speed at the time said material discontinuity is detected;

addressing said memory to select one of said plurality of stored adjustment factors in dependence upon the material feed characteristics of the sewing machine; and adjusting said stitches to be sewn by the adjustment factor selected.

17. In a sewing machine having a reciprocable needle for stitching seams in material, seam length control apparatus comprising:

means for detecting a material discontinuity in advance of a seam;

means for controlling the reciprocable needle to sew a variable number of stitches after said detecting means detects said material discontinuity; and means for adjusting said variable number of stitches to be sewn in dependence upon the sewing speed at the time of detection of said material discontinuity, said adjusting means comprising, means for determining the sewing speed at the time of detection of said material discontinuity; and means for comparing said sewing speed to a predetermined reference speed.

18. In a sewing machine having a material feed and a reciprocable needle for stitching seams in material, a drive motor and a stitch length variance mechanism, seam length control apparatus comprising:

at least one sensor mounted ahead of said needle in a direction opposite the material feed direction for detecting a material discontinuity in advance of a seam;

a microprocessor controller coupled to said sewing machine controls and responsive to said sensor to operate said reciprocable needle to sew a variable number of stitches after said sensor detects said material discontinuity;

said microprocessor controller including means for adjusting said variable number of stitches to be sewn in dependence upon the sewing speed at the time said material discontinuity is detected, said adjusting means comprising memory means for storing a predetermined adjustment factor, said adjusting means being operative to address said memory means and to adjust said variable number of stitches to be sewn by said adjustment factor.

19. A method for controlling seam lengths in a sewing machine having a material feed, a reciprocable needle for stitching seams in material and a microprocessor controller having a memory comprising the steps of:

detecting a material discontinuity in advance of a seam;

controlling the reciprocable needle to sew a variable number of stitches after detecting said material discontinuity; and adjusting said variable number of stitches to be sewn in dependence upon the sewing speed at the time said material discontinuity is detected, said adjusting step comprising:

determining the sewing speed at the time said material discontinuity is detected;

comparing said sewing speed to a predetermined reference speed; and adjusting said stitches to be sewn by a factor equal to the ratio of said predetermined reference speed to said sewing speed.

20. The method of claim 14 wherein said adjusting step comprises:

determining the sewing speed at the time said material discontinuity is detected;

comparing said sewing speed to a predetermined reference speed; and adjusting said stitches to be sewn by a factor equal to the ratio of said predetermined reference speed to said sewing speed.

21. The method of claim 14 further comprising the step of:

storing a plurality of adjustment factors corresponding to various sewing speeds in said memory.

22. The method of claim 21 wherein said adjusting step comprises:

determing the sewing speed at the time said material discontinuity is detected;

addressing said memory to select one of said plurality of stored adjustment factors in dependence upon said sewing speed; and adjusting said stitches to be sewn by the adjustment factor selected.

* * * * *

UNITED STATES PATENT AND TRADEMARK OFFICE

CERTIFICATE OF CORRECTION

PATENT NO. : 4,548,143

DATED : October 22, 1985

INVENTOR(S) : Charles R. Martell, et al.

It is certified that error appears in the above—identified patent and that said Letters Patent is hereby corrected as shown below:

Col. 8, line 16:
Patent Claim 17, should be renumbered as Claim 3 and is independent.

Col. 6, line 43:
Patent Claim 3, should be renumbered as Claim 4 and should be dependent upon Claim 3.

Col. 6, line 48:
Patent Claim 4 should be renumbered as Claim 5 and should be dependent upon Claim 3.

Col. 6, line 53:
Patent Claim 5 should be renumbered as Claim 6 and should be dependent upon Claim 3.

Col. 6, line 58:
Patent Claim 6 should be renumbered as Claim 7 and should be dependent upon Claim 3.

Col. 6, line 63:
Patent Claim 7 should be renumbered as Claim 8 and is independent.

Col. 7, line 12:
Patent Claim 8 should be renumbered as Claim 9 and should be dependent upon Claim 8.

Col. 7, line 18:
Patent Claim 9 should be renumbered as Claim 10 and should be dependent upon Claim 8.

Col. 7, line 24:
Patent Claim 10 should be renumbered as Claim 11 and should be dependent upon Claim 8.

Col. 7, line 57:
Patent Claim 14 should be renumbered as Claim 12 and is independent.

UNITED STATES PATENT AND TRADEMARK OFFICE

CERTIFICATE OF CORRECTION

PATENT NO. : 4,548,143

DATED : October 22, 1985

INVENTOR(S) : Charles R. Martell, et al.

It is certified that error appears in the above—identified patent and that said Letters Patent is hereby corrected as shown below:

Col. 9, line 6:
Patent Claim 20 should be renumbered as Claim 13 and should be dependent upon Claim 12.

Col. 8, line 32:
Patent Claim 18 should be renumbered as Claim 14 and is independent.

Col. 7, line 31:
Patent Claim 11 should be renumbered as Claim 15 and should be dependent upon Claim 14.

Col. 7, line 41:
Patent Claim 12 should be renumbered as Claim 16 and should be dependent upon Claim 14.

Col. 7, line 51:
Patent Claim 13 should be renumbered as Claim 17 and should be dependent upon Claim 14.

Col. 8, line 54:
Patent Claim 19 should be renumbered as Claim 18 and is independent.

Col. 10, line 1:
Patent Claim 21 should be renumbered as Claim 19 and should be dependent upon Claim 18.

Col. 10, line 50:
Patent Claim 22 should be renumbered as Claim 20 and should be dependent upon Claim 18.

UNITED STATES PATENT AND TRADEMARK OFFICE

CERTIFICATE OF CORRECTION

PATENT NO. : 4,548,143

DATED : October 22, 1985

INVENTOR(S) : Charles R. Martell, et al

It is certified that error appears in the above-indentified patent and that said Letters Patent is hereby corrected as shown below:

Col. 8, line 1:

Patent Claim 15 should be renumbered as Claim 21 and should be dependent upon Claim 18.

Col. 8, line 6:
Patent Claim 16 should be renumbered as Claim 22 and should be dependent upon Claim 18.

On the title page, item [54] and col. 1, lines 2-5, the title should read —METHOD AND APPARATUS FOR VARYING THE LENGTH OF STITCHES SEWN BY A SEWING MACHINE IN DEPENDENCE UPON SEWING SPEED—.

This Certificate supersedes Certificate of Correction issued July Twenty-Seventh, 1993

Signed and Sealed this

Thirteenth Day of June, 1995

*Attest:*

Bruce Lehman

BRUCE LEHMAN

*Attesting Officer*

*Commissioner of Patents and Trademarks*